US006030670A

United States Patent [19]

Chang

[11] Patent Number: 6,030,670

[45] Date of Patent: Feb. 29, 2000

[54] DECORATING TREE WITH EMBELLISHING LAMP

[76] Inventor: Chih-Chen Chang, No. 32, Kuang Hwa South Street, Shinchu City, Taiwan

[21] Appl. No.: 08/922,439

[22] Filed: Sep. 3, 1997

[51] Int. Cl.[7] ..... A47G 33/06

[52] U.S. Cl. ..... 428/19; 428/20; 362/123; 362/806

[58] Field of Search ..... 362/123, 806; 428/19, 20, 18

[56] References Cited

U.S. PATENT DOCUMENTS 2,188,529 1/1940 Corina ..... 428/19

*Primary Examiner*—Alexander Thomas
*Attorney, Agent, or Firm*—Rosenberg, Klein & Bilker

[57] ABSTRACT

An artificial decorating tree with embellishing lamps is provided which includes several hollow joints, sockets, connectors, branches, embellishing lamps and a set of electric cords. The decorating tree is assembled with plug-in joints and internal wiring coupled to lamps supported from branches, thereby avoiding the use of exposed light strings external to the artificial tree structure.

2 Claims, 4 Drawing Sheets

DECORATING TREE WITH EMBELLISHING LAMP

BACKGROUND OF THE INVENTION

1. Field of the Invention

The present invention relates to an artificial decorative tree with embellishing lamps. More particularly, the present invention is directed to a decorating tree with embellishing lamps that can be assembled arbitrarily, without any additional light strings.

2. Description of Prior Art

In the past, the Christmas tree was made of a naturally grown pine. Due to the inconvenience of transporting and preserving natural trees, an artificial decorating tree was introduced, in which the branches are detachable from the main trunk. Therefore, the artificial tree can be disassembled into several smaller integral components, such as the main trunk and branches. In fact, the artificial tree is more convenient to transport and preserve then the natural pine, especially for bigger Christmas trees. For either use, people must wind the light strings along the trunk and branch repeatedly during decorating, making the decorating work complicated.

OBJECTS AND SUMMARY OF THE INVENTION

It is therefore a main object of the present invention to provide a decorating tree with embellishing lamps, that is not only easy to transport, preserve, and assemble, and is also without any light strings, connecting plugs and sockets exposed on the outside of the tree.

That object is achieved by providing a decorating tree with embellishing lamps, that is assembled with plug-in joints by which several hollow joint members and hollow branches are coupled. All of the electric cords, connecting plugs, sockets and embellishing lamps are fixed therein.

DETAILED DESCRIPTION OF PREFERRED EMBODIMENTS

Figure 1:
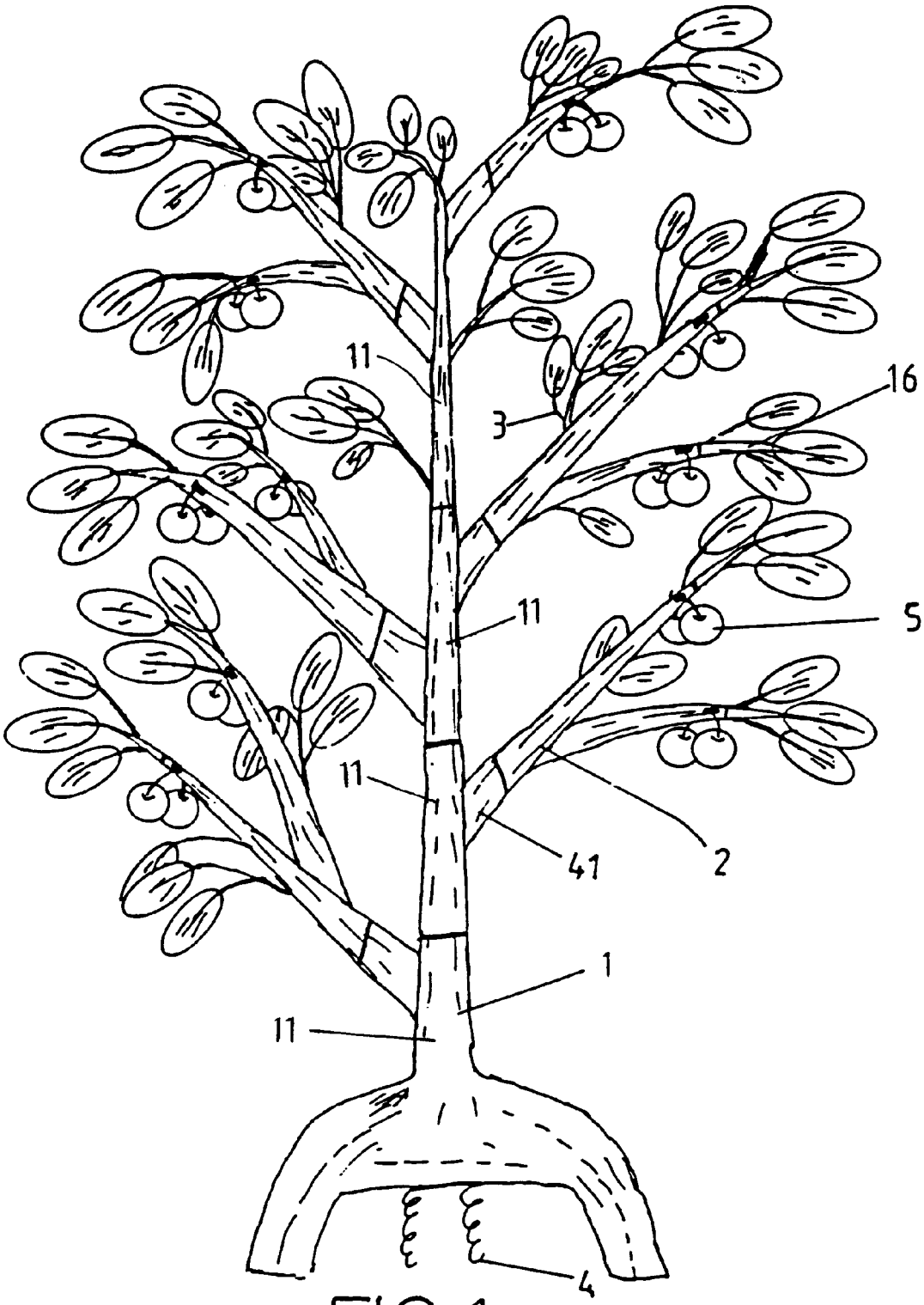
FIG. 1 is an elevation view showing the exterior of the present invention.
Figure 2:
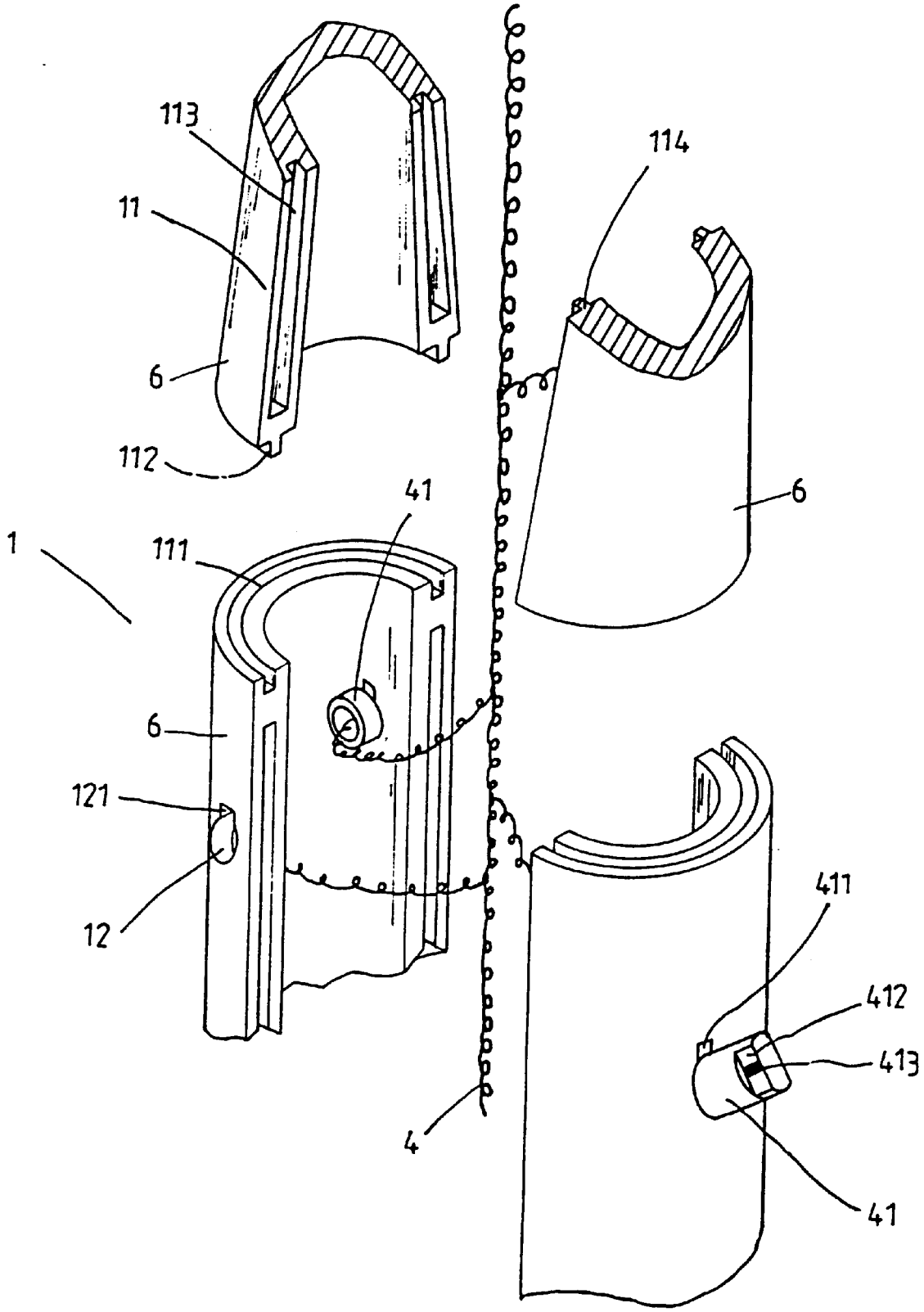
FIG. 2 is an exploded view showing a joint of the trunk of the present invention.

Referring to FIGS. 1 and 2, the present invention includes several hollow joint members 11, sockets 12, connectors 41, branches 2, twigs 3, embellishing lamps 5 and a set of electric cords 4.

The main trunk 1 included several hollow joint members 11 that are connected to each other to form a trunk shaped body. Each hollow joint member 11 has a ring groove 111 formed at the top end thereof, and a protruding wall 112 formed at the bottom end. The protruding wall 112 of one hollow joint member 11 in inserted into the ring groove 111 of a next hollow joint member 11, to connect the hollow joint members 11 one by one, as shown in FIG. 2. Each hollow joint member 11 is divided into two half portions 6 extending in an axial direction. The half portions 6 are joined together by projection and groove means. One half portion 6 has a couple of grooves 113 formed on side end sections thereof. The corresponding half portion 6 has a couple of projecting bars 114 formed on the end sections thereof. On each hollow joint member 11, is an appropriate number of sockets 12, each having a notch 121 for locating a respective connector 41 therein. Every connector 41 is connected to the electric cord 4.

Figure 3:
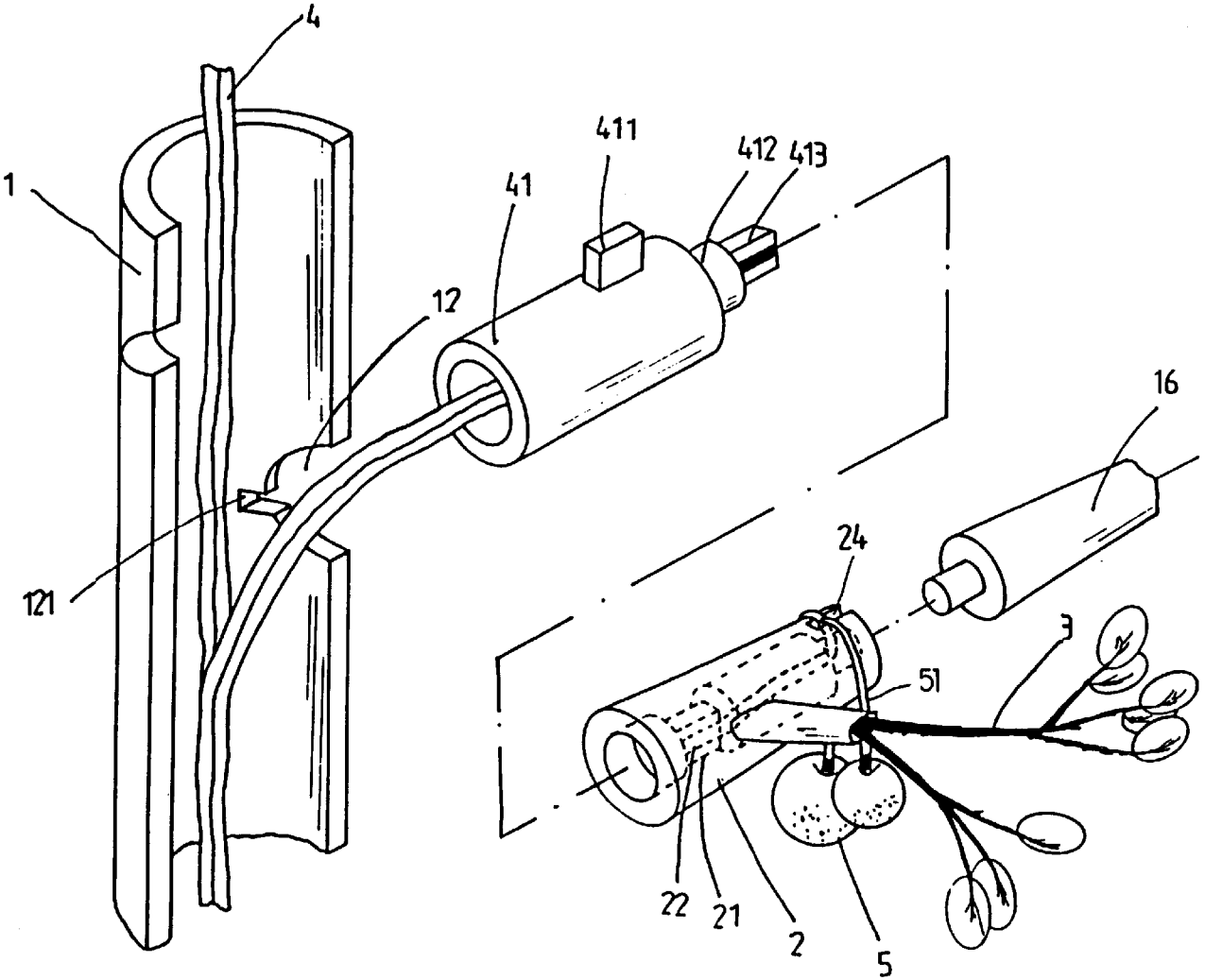
FIG. 3 is an exploded view showing a joint of a branch of the present invention.
Figure 4:
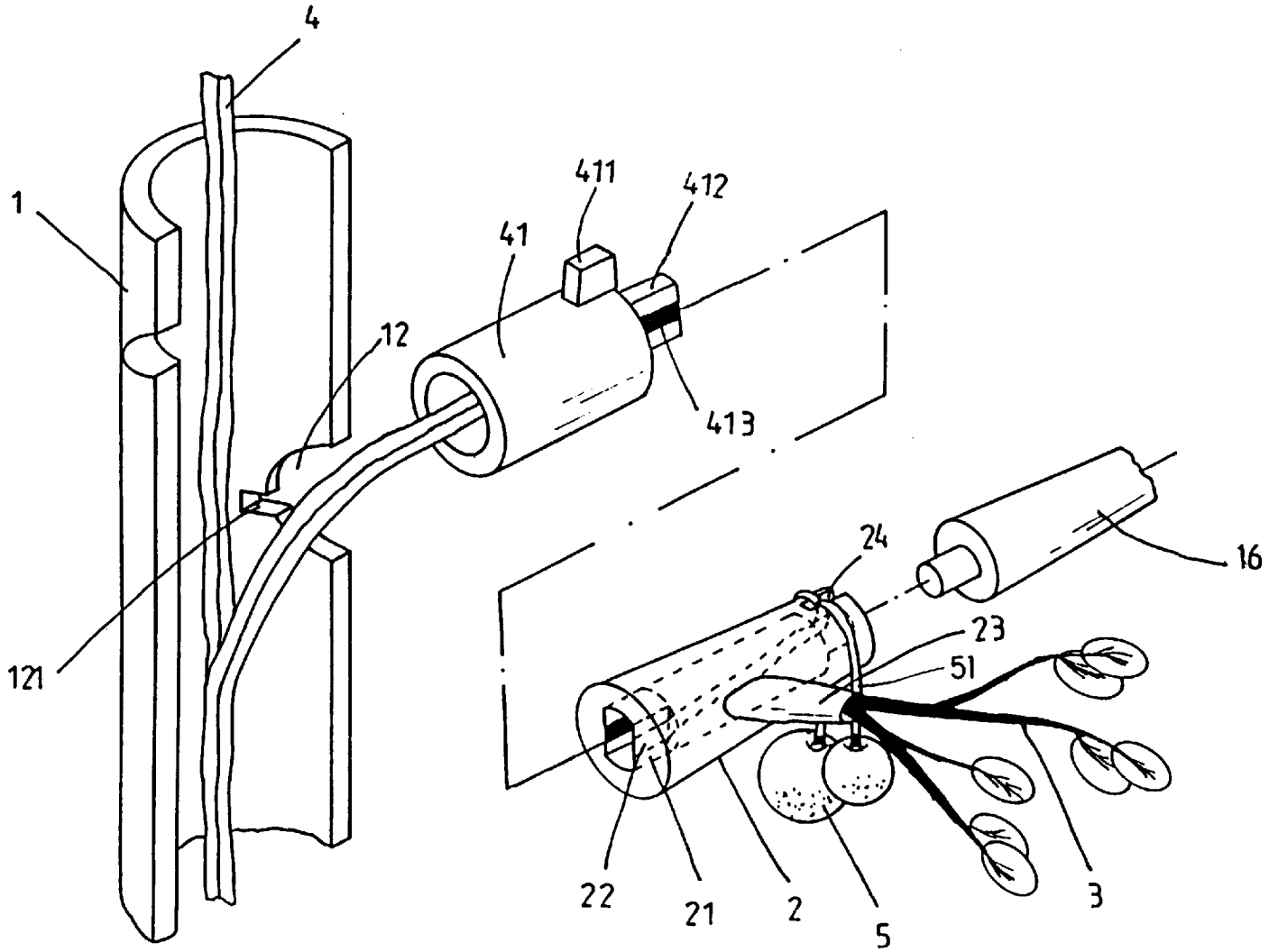
FIG. 4 is an exploded view showing operation of the joint of the trunk of the present invention.

Referring to FIG. 3 and FIG. 4, each connector 41 is shaped as a cartridge with a lug 411 for fitting into the notch 121 on the socket 12 to locate the connector 41 on the joint member 11. A tongue 412 extends from an end of each connector 41 and has a couple of plug strips 413 connected to the main electric cord 4. As shown in FIG. 3 and FIG. 4, each connector 41 joins with a jack 21 at the bottom end of a hollow branch 2, corresponding to the tongue 412 and the plug strips 413 of the connector 41. The jack has a couple of jack strips 22 for coupling the power source to the embellishing lamps 5 that are attached on the branch 2. The other end of the branch 2 is formed with a gap 24 for attaching the embellishing lamps 5 by connecting a twig 16 into the gap 24 and passing the leads 51 of the embellishing lamps 5 through the gap 24. The branch 2 has a fork seat 23 formed on the shaft for attaching twigs 3.

I claim:

1. A decorating tree, comprising:

a plurality of hollow joint members axially coupled together to form a tree trunk shaped body, each of said plurality of joint members having at least one socket formed therein;

a set of electric cords disposed within said tree trunk shaped body;

a plurality of cartridge shaped connectors respectively disposed within said sockets of said plurality of joint members, each of said connectors having a tongue extending therefrom and carrying a pair of plug strips that are respectively electrically connected to said set of electric cords;

a plurality of branch members coupled to said tree trunk shaped body, each of said plurality of connectors having an electrical jack formed in a bottom end thereof for coupling with said tongue of a respective one of said plurality of connectors; and, a plurality of embellishing lamps respectively coupled to said plurality of branch members, each of said embellishing lamps being electrically connected to said pair of plug strips of a respective connector.

2. The decorating tree as recited in claim 1 where each of said plurality of joint members is formed by a pair of half portion members coupled together, each of said pair of half portion members having a groove formed in an upper end thereof and a projection formed on a lower end thereof for coupling to other of said plurality of joint members, a first of said pair of half portion members having a pair of grooves formed in side end sections thereof, a second of said pair of half portion members having a pair of projecting bars formed on side end sections thereof for respective insertion into said pair of grooves of said first half portion member.

* * * * *